US007516509B2

(12) United States Patent
Yu

(10) Patent No.: US 7,516,509 B2
(45) Date of Patent: Apr. 14, 2009

(54) PNEUMATIC DEVICE FOR CLEANING VENTILATION DUCTS

(76) Inventor: Jiang Yu, East Building No. 39, Zhongwu Xincun Bieshu Xiaoqu, Haidian District, Beijing (CN) 100089

( * ) Notice: Subject to any disclaimer, the term of this patent is extended or adjusted under 35 U.S.C. 154(b) by 0 days.

(21) Appl. No.: 11/817,317

(22) PCT Filed: Feb. 28, 2005

(86) PCT No.: PCT/CN2005/000241

§ 371 (c)(1),
(2), (4) Date: Aug. 28, 2007

(87) PCT Pub. No.: WO2006/089461

PCT Pub. Date: Aug. 31, 2006

(65) Prior Publication Data

US 2008/0155780 A1 Jul. 3, 2008

(51) Int. Cl.
*A47L 25/00* (2006.01)

(52) U.S. Cl. ..... 15/104.05; 15/318; 15/340.3; 15/383; 15/387; 15/400; 15/406

(58) Field of Classification Search ..... 15/104.05, 15/104.066, 304, 316.1, 318, 340.3, 383, 15/387, 400, 405, 406; *A47L 25/00*
See application file for complete search history.

(56) References Cited

U.S. PATENT DOCUMENTS 5,003,998 A * 4/1991 Collett ..... 134/22.12
5,383,975 A * 1/1995 Faxon ..... 134/22.11
5,551,458 A * 9/1996 Faxon ..... 134/22.12

* cited by examiner

*Primary Examiner*—David A Redding
(74) *Attorney, Agent, or Firm*—Christensen O'Connor Johnson Kindness PLLC

(57) ABSTRACT

The present application relates to a pneumatic device for cleaning ventilation ducts, which includes a guiding air hammer, a turning conduit, an air-supply pipe and a slewing mechanism for the conduit. The guiding air hammer has a hollow spherical or hemispherical shape and is connected to the turning conduit. A cleaning fumarole and a guiding fumarole are provided on the rear arc wall of the guiding air hammer. When in operation, the air-supply pipe stretching means retracts and stretches the air-supply pipe, which enables the guiding air hammer to clean out the dust on the inner walls and in the corners of a ventilation duct without the need of an operator entering the ventilation duct. The air-supply pipe stretching means may be controlled by manual operation or program composition. The device may be used for cleaning ventilation ducts with a polygonal section.

9 Claims, 7 Drawing Sheets

PNEUMATIC DEVICE FOR CLEANING VENTILATION DUCTS

FIELD OF THE INVENTION

The present invention relates to a kind of cleaning device, and more specifically relates to a kind of pneumatic device for cleaning ventilation ducts.

BACKGROUND OF THE INVENTION

In the prior art, the method that manual operations accompany with high pressure air vehicles is generally used for cleaning the ducts, in which high pressure air is utilized for cleaning. For the ducts with large diameter, cleaning operator must enter the ducts to clean them, which results in great labor strength and bad working environment. The applicant has applied a Chinese patent application No. 200310113320.X on Nov. 14, 2003. The title of the patent application is cleaner for ventilation ducts, and the technique solution of this patent application is that the cleaning work was fulfilled by the cleaner for ventilation ducts carried by vehicles entering into the ducts, it has bigger volume and great loss of air force. The invention could only be used in horizontally arranged ducts with large diameters; however, as to the ducts with small diameter, the ducts with lower tuyere, and the complicated ducts with many turnings, the vehicles can not get into the ventilation ducts to work.

SUMMARY OF THE INVENTION

The technical problems the invention intends to solve are to overcome the disadvantages of the prior arts, and to provide a pneumatic device for cleaning ventilation ducts with small volume and simple structure, which is easy to use.

The pneumatic device for cleaning ventilation ducts of the present invention comprises a guiding air hammer, a turning conduit, an air-supply pipe, and a slewing mechanism for the conduit. Said guiding air hammer is a hollow spherical or hemispherical shape which connects to the turning conduit. The other end of said turning conduit is connected fixedly with the turning pipe of the slewing mechanism for the conduit. Said air-supply pipe is connected with the air inlet pipe at the other end of the slewing mechanism for the conduit.

Jets of air for cleaning and jets of air for guiding are formed on the rear arc wall of said guiding air hammer, and said jets of air for cleaning are several proportionally distributed centripetal holes, whose center lines of the jets of air for cleaning make an angle of 35°-65° with the center line of guiding air hammer. Said jets of air for guiding are two centripetal holes, whose center lines make an angle of 65°-80° with the center line of guiding air hammer, and the center lines of the two jets of air for guiding make an angle of 75°-105° with each other.

Said slewing mechanism for the conduit comprises shell, stepper motor, revolving seal, turning pipe, air inlet pipe, and air inlet cover. The stepper motor is set at the rear of said shell, and there is space between the stepper motor and the shell. The air inlet cover is arranged on the shaft extension of drive shaft of stepper motor. Said revolving seal is arranged in the front of the shell, and the turning pipe is arranged inside the revolving seal. Said turning pipe is fixedly connected to the air inlet cover. The air inlet pipe is arranged fixedly at the rear of the shell.

In front of the shell of the slewing mechanism for the conduit, a front protecting cover is arranged, in which pick-up lens and several jacklights are arranged.

At the rear end of said slewing mechanism for the conduit back, cover is arranged, in which connector sockets for pick-up lens and jacklights are arranged.

Rolling wheels are arranged under said slewing mechanism for the conduit.

A blowpipe directed to the pick-up lens is arranged on the front protecting cover beside said pick-up lens, the other end of which links with the air chamber inside the shell.

Another embodiment of the pneumatic device for cleaning ventilation ducts of the present invention comprises guiding air hammer, turning conduit, air-supply pipe, and slewing mechanism for the conduit. Said guiding air hammer is a hollow spherical or hemispherical shape, connected to the turning conduit.

Jets of air for cleaning and jets of air for guiding are formed on the rear arc wall of said guiding air hammer. Said jets of air for cleaning are several proportionally distributed centripetal holes, whose center lines make an angle of 35°-65° with the center line of guiding air hammer. Said jets of air for guiding are two centripetal holes, whose center lines make an angle of 65°-80° degrees with the center line of guiding air hammer, and the center lines of two jets of air for guiding make an angle of 75°-105° with each other.

Said slewing mechanism for the conduit consists of stepper motor and revolving seal. Said drive shaft of stepper motor is a hollow one. The revolving seal is arranged fixedly at the rear end of the stepper motor's shell. The rear end of the drive shaft of stepper motor connects with one of the revolving seal's ends, and said air-supply pipe connects with the other end of revolving seal which is arranged fixedly on the shell of stepper motor, and the other end of said turning conduit connects with the front end of the drive shaft of stepper motor.

Pick-up lens and several jacklights could be arranged at the front side of stepper motor.

Power line and signal line are arranged in the wall of air-supply pipe.

Radial brush is arranged on the front end of the guiding air hammer.

Automatic retractor is also arranged on the air-supply pipe outside the ventilation ducts to be cleaned. The automatic retractor consists of stepper motor, supporting driver, adjusting screw, guiding pole, active board, bottom board, supporting wheel, and bracket for supporting wheel. The bracket for supporting wheel is arranged fixedly on the bottom board, and the supporting wheel is hinged on the bracket for supporting wheel. The guiding pole is arranged fixedly on the bottom board vertically. Said stepper motor is arranged fixedly on the active board, and the friction driver is arranged on the shaft extension of stepper motor, whose position inosculates with supporting wheel. Guiding holes and threaded holes are formed in the active board, in which the guiding hole fits together the guiding pole, and the adjusting screw fits into the threaded holes, whose lower end is hinged on the bottom board, said air-supply pipe is arranged between the supporting wheel and the friction driver.

Screws are also arranged on the bottom board for clamping the fixing bracket.

When the device for Cleaning Ventilation Ducts is used to clean the cylindrical ducts, the stepper motor arranged in the shell of the slewing mechanism for the conduit controls the revolving of the guiding air hammer, the turning pipe, and the turning conduit. The guiding air hammer and turning conduit revolves when necessary. By using the jets of air that be ejected towards sideling back directions come from the jets of air for cleaning of the guiding air hammer, the turning conduit is stretched. The guiding air hammer revolves along the inner wall of cylindrical ducts. Cooperating with the automatic retractor, the air-supply pipe could be retracted, thus the cleaning track of the guiding air hammer coming back is formed, and the dust in ventilation ducts is cleaned out of the ducts.

When the device is cleaning the rectangular ventilation ducts, being controlled by the stepper motor, the guiding air hammer and the turning conduit stop revolving and then the guiding air hammer cleans the inner wall of rectangular ducts vertically or horizontally by the ejecting effect of jets of air for guiding. When the guiding air hammer moves to turning corner of the rectangular ducts, the stepper motor rotates 90 degrees, so that the guiding air hammer and turning conduit rotate 90 degrees too because of the rotated effect of stepper motor. In the same way, the guiding air hammer's rectangular rearward turning is fulfilled. Cooperating with the retracting of the air-supply pipe, the rectangular cleaning track of the guiding air hammer coming back is formed, and the dust in ventilation ducts is cleaned out of the ducts.

During the process of cleaning the ventilation ducts, the blowpipe beside the pick-up lens blows clean air continuously to prevent the pick-up lens from being polluted and shaded by dust. During the work, the cleaning process could be monitored by jacklights and pick-up lens. By the operation of automatic retractor, the air-supply pipe could be retracted, thus an even cleaning is achieved.

Advantages of the pneumatic device for cleaning ventilation ducts that the present invention related is: during the device cleaning the ventilation ducts, operator does not have to enter into the ducts. According to the principle of air motion of the guiding air hammer, cooperating with the guiding air hammer's direction controlling by slewing mechanism for the conduit, and the air-supply pipe's retracting and stretching by the retracting and driving device for air-supply pipe's manually operation or program composition, the dust on inner wall and each corner of ventilation ducts could be cleaned. Accompanying with the monitoring pick-up lens and the rolling wheel arranged under the slewing mechanism for the conduit, the retracting resistance of pipe in ventilation ducts is decreased. The brush in front of the guiding air hammer could be used to avoid the damage by the guiding air hammer to other devices inside the ventilation ducts. The design of the invention could be used for cleaning all ventilation ducts with polygonal section. According to the present invention, the pneumatic device for cleaning ventilation ducts has compact structure, has an advantage of automated operation, may clean any corner of the ventilation duct, decreased the number of operators, and reduced the labor strength of the operator greatly.

Figure 1:
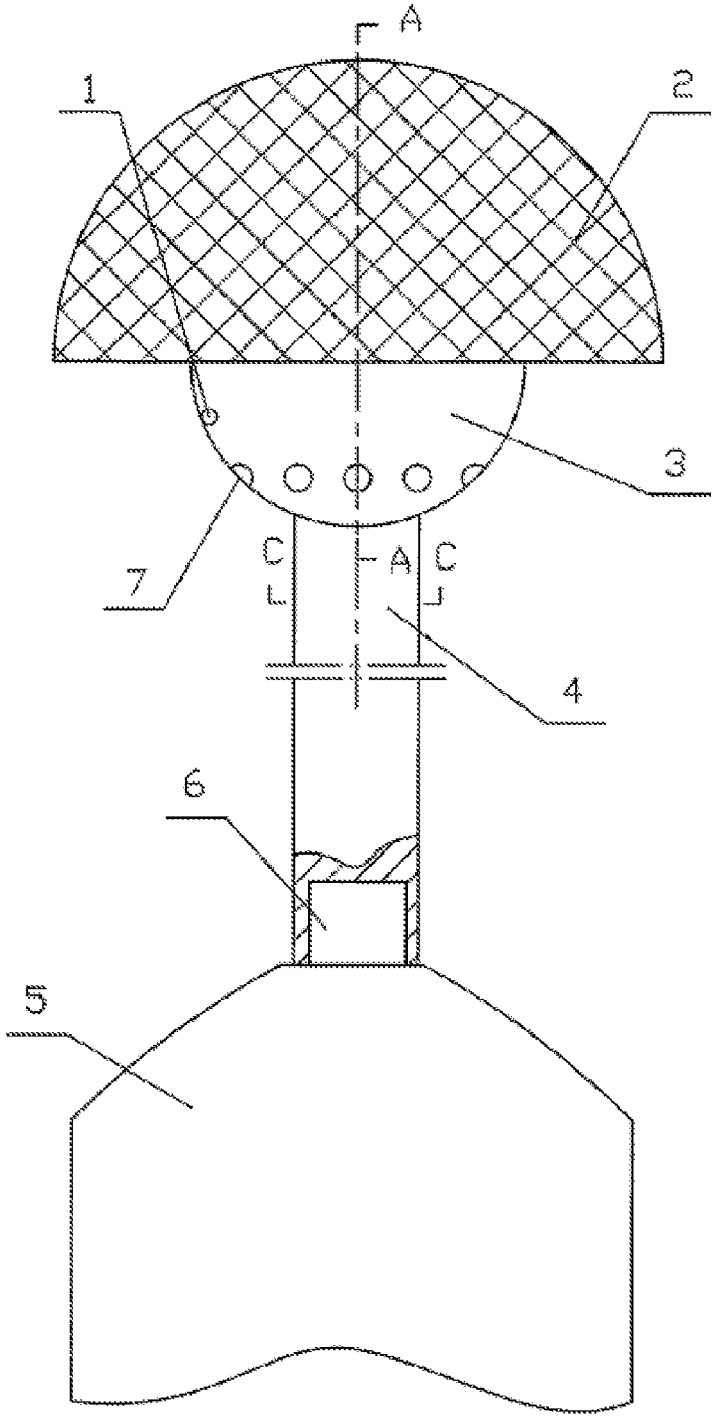
FIG. 1 is a schematic drawing showing the structure of the guiding air hammer in present invention.

The foregoing figures includes jets of air for guiding 1, brush 2, guiding air hammer 3, turning conduit 4, slewing mechanism for the conduit 5, turning pipe 6, jets of air for cleaning 7, pick-up lens 8, bearing 9, front protecting cover 10, jacklight 11, cover of flange 12, stepper motor 13, back cover 14, air inlet pipe 15, air-supply pipe 16, connector socket 17, shell 18, bearing pedestal 19, blowpipe 20, air inlet cover 21, air chamber 22, mechanical seal 23, rolling wheel 24, friction driver 25, adjusting screw 26, stepper motor for friction wheel 27, active board 28, guiding pole 29, bracket for supporting wheel 30, supporting wheel 31, bottom board 32, wall of ventilation ducts 33, fixing bracket 34, revolving seal 35, drive shaft of stepper motor 36.

The invention will be described further in combination with the accompanying drawings.

DETAILED DESCRIPTION OF THE PREFERRED EMBODIMENTS

Figure 2:
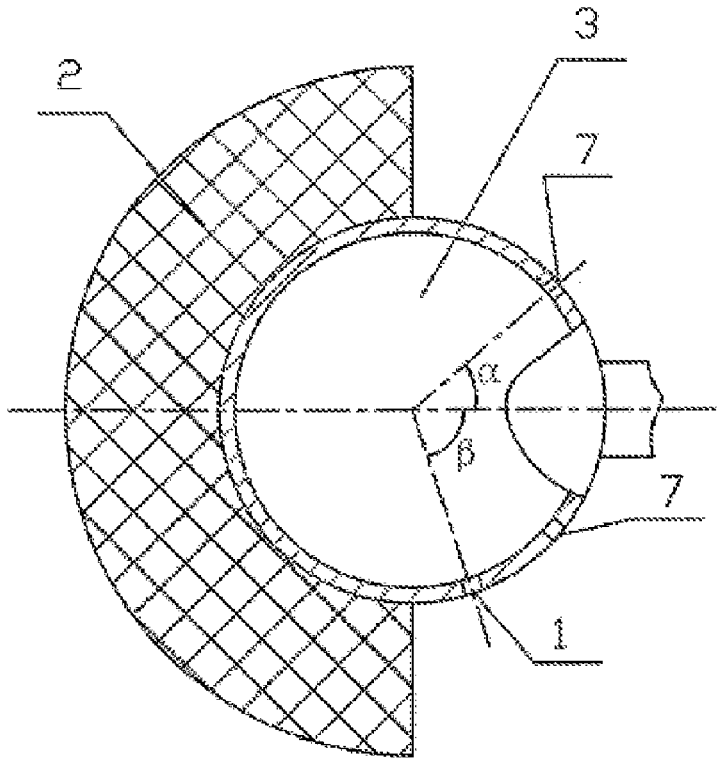
FIG. 2 is a partial sectional view along the line A-A as shown in FIG. 1.
Figure 3:
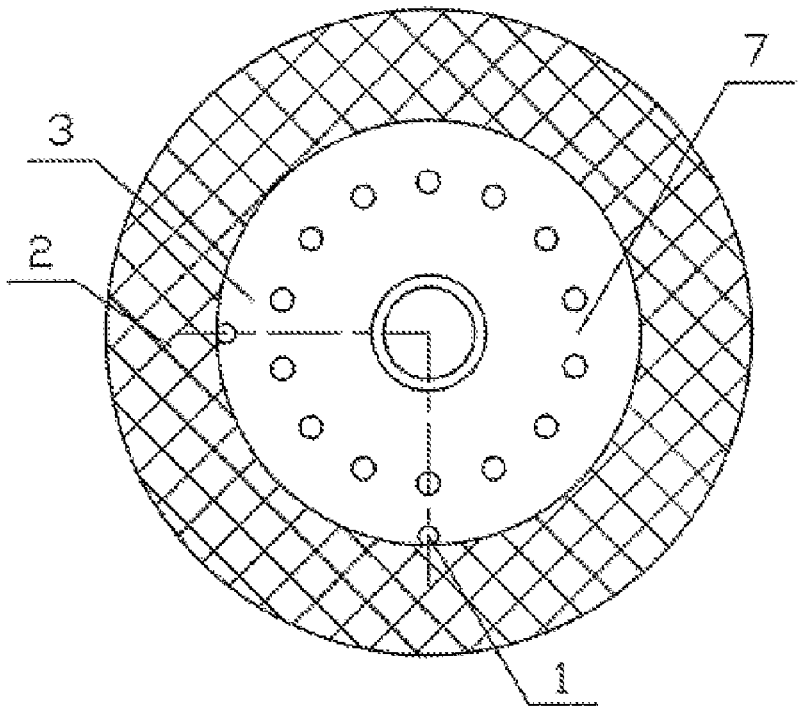
FIG. 3 is a sectional view along the line C-C as shown in FIG. 1.

As shown in FIG. 1-FIG. 3, an embodiment of the pneumatic device for cleaning ventilation ducts of present invention comprises a guiding air hammer 3, a turning conduit 4, an air-supply pipe 16, and a slewing mechanism for the conduit 5. Said guiding air hammer 3 is a hollow spherical or hemispherical shape which connects to the turning conduit 4. The other end of said turning conduit 4 is arranged fixedly to the turning pipe 6 of the slewing mechanism for the conduit 5. Said air-supply pipe 16 is connected with air inlet pipe at the other end of the slewing mechanism for the conduit 5.

Jets of air for cleaning 7 and jets of air for guiding 1 are formed on the rear arc wall of said guiding air hammer 3, and said jets of air for cleaning 7 are several proportionally distributed centripetal holes, whose center lines make an angle of 35°-65° with the center line of guiding air hammer 3. Said jets of air for guiding 1 are two centripetal holes, whose center lines make an angle of 65°-80° with the center line of guiding air hammer 3, and the center lines of the two jets of air for guiding 1 make an angle of 75°-105° with each other.

Figure 4:
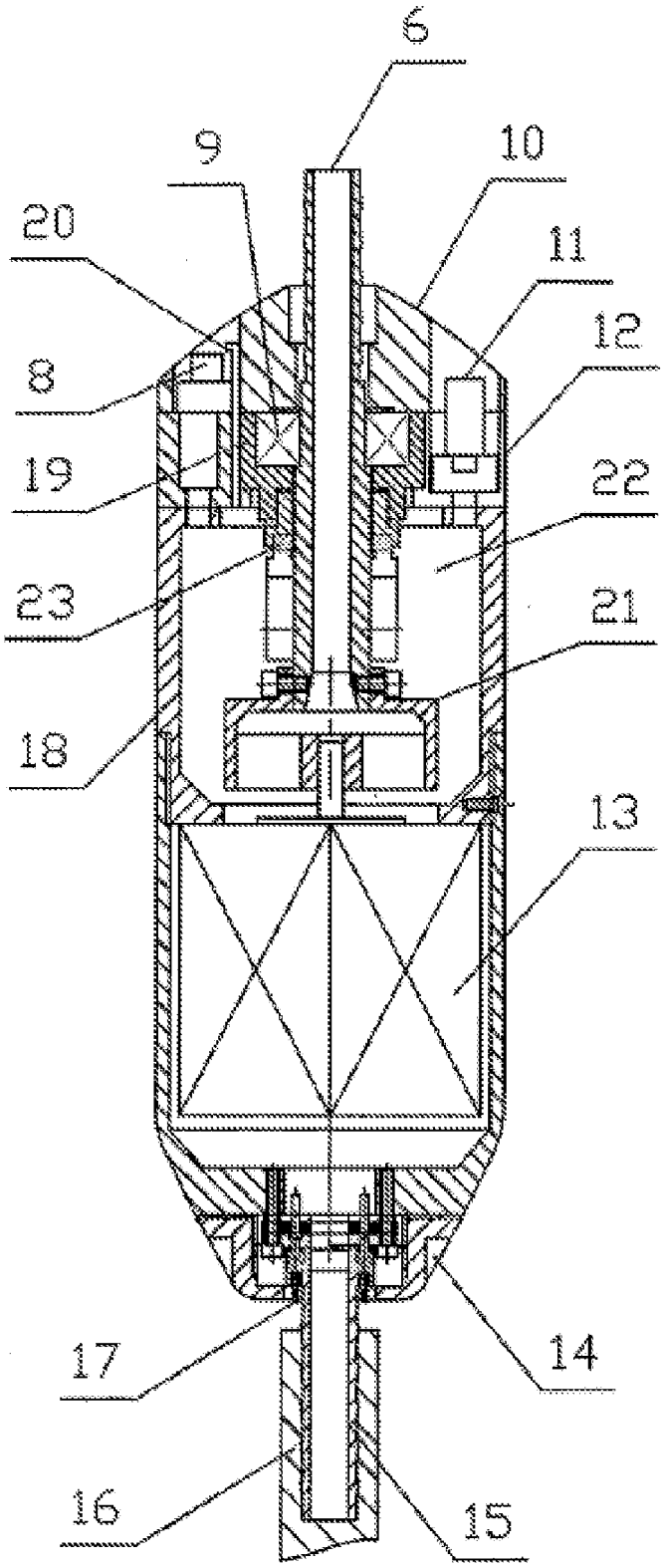
FIG. 4 is a schematic drawing showing the transverse section of the slewing mechanism for the conduit in present invention.
Figure 5:
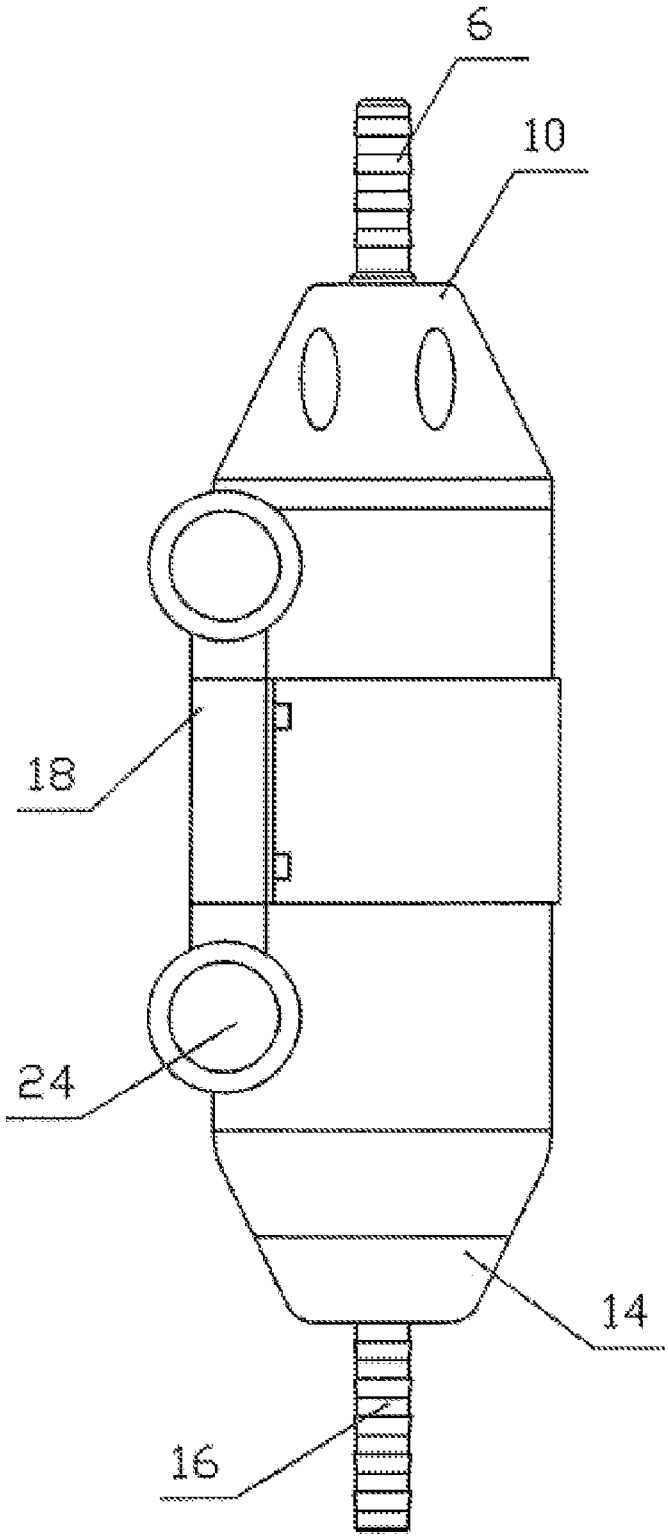
FIG. 5 is a schematic drawing showing the figure according to FIG. 4.
Figure 6:
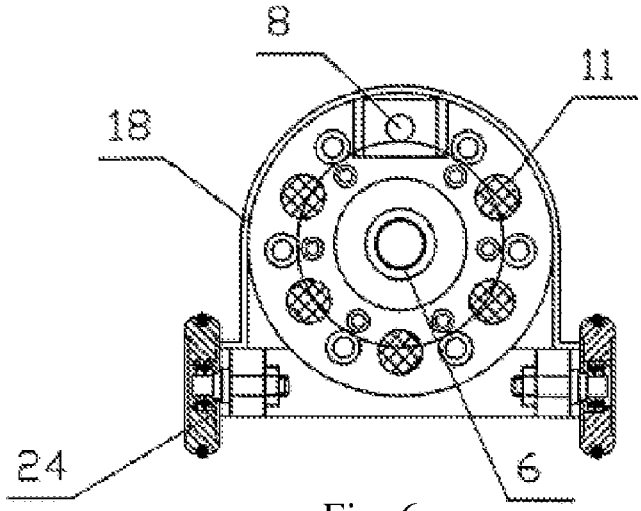
FIG. 6 is a side view of FIG. 5.
Figure 7:
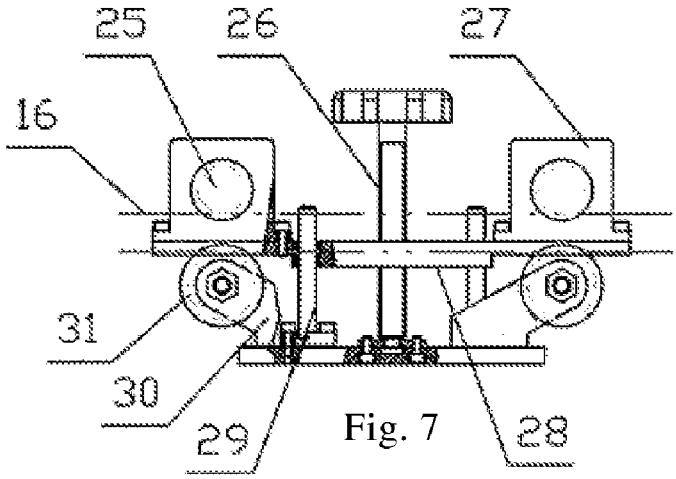
FIG. 7 is the front view of the automatic retractor in present invention.
Figure 8:
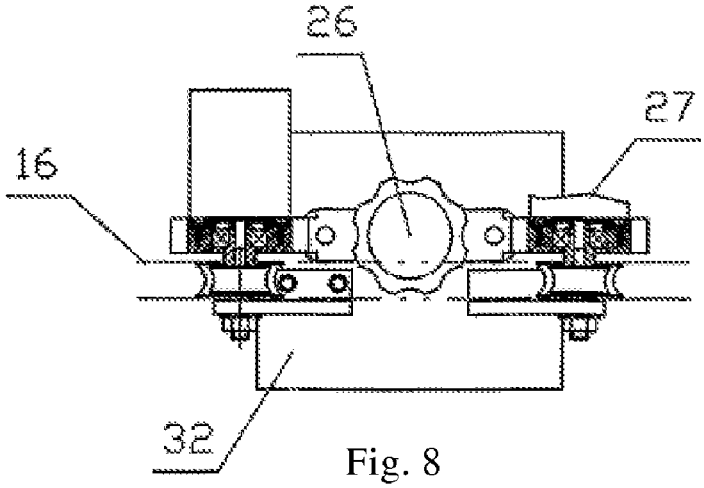
FIG. 8 is a top plan view of FIG. 7.
Figure 9:
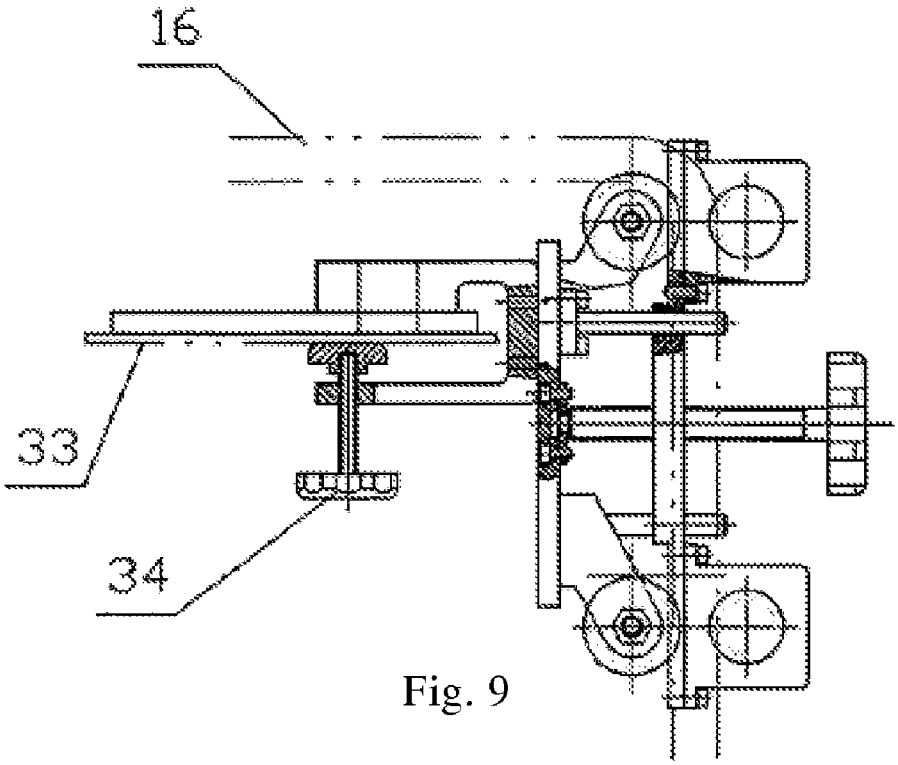
FIG. 9 is a vertical mounting schematic-drawing of the automatic retractor in present invention.
Figure 10:
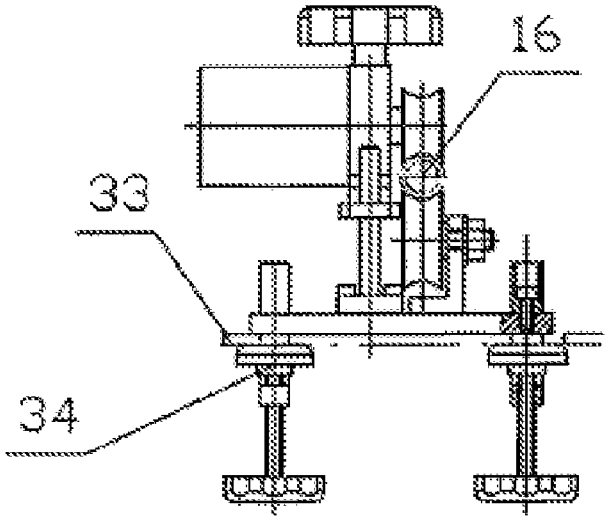
FIG. 10 is a horizontal mounting schematic-drawing of the automatic retractor in present invention.
Figure 11:
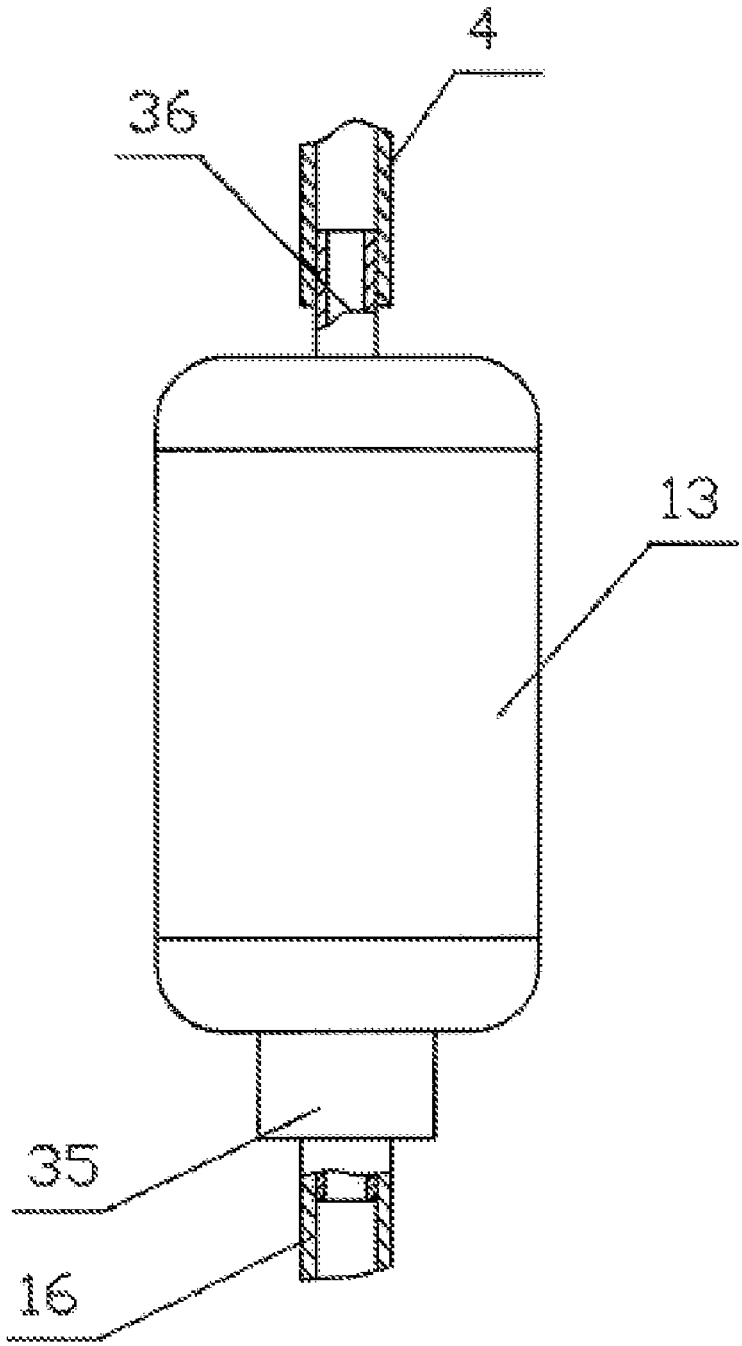
FIG. 11 is a partial sectional view of another embodiment of the slewing mechanism for the conduit in present invention.

As shown in FIG. 4-FIG. 6, the slewing mechanism for the conduit 5 comprises shell 18, stepper motor 13, revolving seal, turning pipe 4, air inlet pipe 15, and air inlet cover 21. The stepper motor 13 is arranged at the rear end of said shell 18, and there is space between the stepper motor 13 and the shell 18. The air inlet cover 22 is arranged on the shaft extension of drive shaft of the stepper motor 13. Said revolving seal consists of mechanical seal 23, bearing 9, and bearing pedestal 19, wherein the cover of flange 12 is arranged at front of the shell 12, in which the bearing 9 and bearing pedestal 19 are arranged. Said turning pipe 6 was arranged inside the bearing pedestal 19, and the mechanical seal 23 is arranged on the turning pipe 6, and said turning pipe 6 is connected fixedly with the air inlet cover 21. The air inlet pipe 15 is arranged fixedly at the rear end of the shell 18.

Front protecting cover 10 is arranged in front end of the shell 18 of said slewing mechanism for the conduit 5, in which pick-up lens 8 and several jacklights 11 are arranged.

Back cover 14 is arranged at the rear end of said slewing mechanism for the conduit 5, and connector socket 17 for pick-up lens 8 and jacklights 11 are arranged in the back cover 14.

Under the slewing mechanism for the conduit 5 rolling wheels 24 are arranged.

Blowpipe 20 directed to the pick-up lens 8 is arranged on the front protecting cover 10 beside said pick-up lens 8, the other end of the blowpipe 20 links with the air chamber 22 inside the shell 18.

As shown in FIG. 1-FIG. 3 and FIG. 11, another embodiment of the present invention, it comprises guiding air hammer 3, turning conduit 4, air-supply pipe 16, and slewing mechanism for the conduit 5. Said guiding air hammer 3 is a hollow spherical or hemispherical shape, and the guiding air hammer 3 connects to the turning conduit 4. The other end of said turning conduit 4 connected fixedly with the turning pipe 6 of the slewing mechanism for the conduit 5. Said air-supply pipe 16 connected with the air inlet pipe 15 at the other end of the slewing mechanism for the conduit 5.

Jets of air for cleaning 7 and jets of air for guiding 1 are formed on the rear arc wall of said guiding air hammer 3, and said jets of air for cleaning 7 are several proportionally distributed centripetal holes, whose center lines make an angle of 35°-65° with the center line of guiding air hammer 3. Said jets of air for guiding 1 are two centripetal holes, whose center lines make an angle of 65°-80° with the center line of guiding air hammer 3, and the center lines of the two jets of air for guiding make an angle of 75°-105° with each other.

Said slewing mechanism for the conduit consists of stepper motor 13 and revolving seal 35. Drive shaft of stepper motor 36 is a hollow one. The revolving seal 35 is arranged fixedly at the rear end of the stepper motor's shell, and the rear end of the drive shaft of stepper motor 36 connects with one end of the revolving seal 35, and said air-supply pipe 16 connects with the other end of revolving seal 35 that is arranged fixedly on the shell of stepper motor 13, and the other end of said turning conduit 4 connects with the front end of the drive shaft of stepper motor 36.

Pick-up lens 8 and several jacklights 11 could be arranged at the front end of stepper motor 13.

In the above two embodiments, the power line and the signal line are arranged in the wall of air-supply pipe 16.

Radial brush 2 is arranged at the front end of the guiding air hammer 3.

As shown in FIG. 7-FIG. 10, automatic retractor is arranged on the air-supply pipe 16 outside the ventilation ducts to be cleaned, and said automatic retractor consists of stepper motor for friction wheel 27, friction driver 25, adjusting screw 26, guiding pole 29, active board 28, bottom board 32, supporting wheel 31, and bracket for supporting wheel 30. The bracket for supporting wheel 30 is arranged fixedly on said bottom board 32. The supporting wheel 31 is hinged on the bracket for supporting wheel 30, and the guiding pole 29 is arranged fixedly on the bottom board 32 vertically. The stepper motor for friction wheel 27 is arranged fixedly on the active board 28. The friction driver 25 is arranged on the shaft extension of stepper motor for friction wheel 27, whose position inosculates with supporting wheel 31. Guiding holes and threaded holes are formed in the active board 28, in which the guiding hole fits together the guiding pole 29, and the adjusting screw 26 fits into the threaded holes. The lower end of adjusting screw 26 is hinged on the bottom board 32, and said air-supply pipe 16 is arranged between the supporting wheel 31 and the friction driver 25.

Screws are also arranged fixedly on the bottom board 32 for clamping the fixing bracket 34.

In the two embodiment of the present invention, air-supply pipe 16 could be retracted for cleaning by using the automatic retractor, or by using the capstan. The air-supply pipe could be retracted quickly or slowly by manual operation or electric operation. The brush 2 arranged on the guiding air hammer 3 serves not only the device assisting the clean work of the guiding air hammer 3, but also the device forbidding damage of the guiding air hammer 3 to wire and other apparatus in ventilation ducts. During entering into the ventilation ducts to be cleaned, the guiding air hammer 3 could get into the duct by the effect of air jet. During cleaning, the cleaning work is fulfilled by retracting means, so the dust in ventilation duct could be expelled easily.

The invention claimed is:

1. A pneumatic device for cleaning ventilation ducts, comprising a guiding air hammer, turning conduit, air-supply pipe, and a slewing mechanism for the conduit, said guiding air hammer being a hollow spherical or hemispherical shape, which is connected to the turning conduit, and the other end of said turning conduit connected fixedly with a turning pipe of the slewing mechanism for the conduit, and the air-supply pipe connected with an air inlet pipe on the other end of the slewing mechanism for the conduit, wherein air jets for cleaning and air jets for guiding are formed on a rear arc wall of said guiding air hammer, in which said air jets for cleaning are several proportionally distributed centripetal holes, whose center lines make an angle of 35°-65° with the center line of the guiding air hammer, and said air jets for guiding are two centripetal holes, whose center lines make an angle of 65°- 80° with the center line of the guiding air hammer, and the two center lines of air jets for guiding make an angle of 75°-105° with each other; and said slewing mechanism for the conduit comprises a shell, stepper motor, revolving seal, turning pipe, air inlet pipe and an air inlet cover, in which the stepper motor is arranged in the back of said shell, and there is space between the stepper motor and the shell, and the air inlet cover is arranged on a shaft extension of a drive shaft of the stepper motor, and said revolving seal is installed in the front side of the shell, and the turning pipe is arranged inside the revolving seal, the turning pipe connecting fixedly with the air inlet cover, and the air inlet pipe connecting fixedly to the rear end of the shell.

2. The pneumatic device for cleaning ventilation ducts according to claim 1, wherein said slewing mechanism for the conduit includes:

a front protecting cover, in which a pick-up lens and several jacklights are arranged, a back cover, which is arranged at the rear end of said slewing mechanism for the conduit, and in which connector sockets for the pick-up lens and jacklight are arranged, and a rolling wheel, which is arranged under said slewing mechanism for the conduit.

3. The pneumatic device for cleaning ventilation ducts according to claim 2, wherein a blowpipe directed to the pick-up lens is arranged on the front protecting cover beside the pick-up lens, and the other end of the blowpipe links with an air chamber inside the shell.

4. A pneumatic device for cleaning ventilation ducts, comprising a guiding air hammer, turning conduit, air-supply pipe and a slewing mechanism for the conduit, in which said guiding air hammer has a hollow spherical or hemispherical shape and is connected to the turning conduit, wherein air jets for cleaning and air jets for guiding are formed on a rear arc wall of said guiding air hammer, in which said air jets for cleaning are several proportionally distributed centripetal holes, whose center lines make an angle of 35°- 65° with the center line of guiding air hammer, and said air jets for guiding are two centripetal holes, whose center lines make an angle of 65°- 80° with the center line of the guiding air hammer, and the center lines of two air jets for guiding make an angle of 75°-105° with each other; and said slewing mechanism for the conduit comprises a stepper motor and revolving seal, in which a drive shaft of the stepper motor is hollow, and the revolving seal is arranged fixedly at the rear end of the stepper motor's shell, and the rear end of the drive shaft of the stepper motor connects with one end of the revolving seal, wherein said air-supply pipe connects with the other end of the revolving seal that is arranged fixedly on the shell of the stepper motor, and the other end of said turning conduit connects with the front end of the drive shaft of the stepper motor.

5. The pneumatic device for cleaning ventilation ducts according to claim 4, wherein a pick-up lens and jacklight may be arranged in front of the stepper motor.

6. The pneumatic device for cleaning ventilation ducts according to claim 1 or claim 4, wherein a power line and signal line are arranged in a wall of said air-supply pipe.

7. The pneumatic device for cleaning ventilation ducts according to claim 1 or claim 4, wherein a radial brush is arranged in front of said guiding air hammer.

8. The pneumatic device for cleaning ventilation ducts according to claim 1 or claim 4, wherein an automatic retractor is also arranged on the air-supply pipe outside the ventilation ducts to be cleaned, and said automatic retractor comprises a stepper motor, supporting driver, adjusting screw, guiding pole, active board, bottom board, supporting wheel and a bracket for a supporting wheel, in which the bracket for the supporting wheel is arranged fixedly on said bottom board, the supporting wheel is hinged on the bracket for the supporting wheel, and the guiding pole is arranged fixedly on the bottom board vertically, said stepper motor being arranged fixedly on the active board, and a friction driver being arranged on a shaft extension of the stepper motor, whose position inosculates with the supporting wheel, guiding holes and threaded holes that are formed in the active board, wherein a guiding hole fits together the guiding pole, and the adjusting screw fits into the threaded holes, and the lower end of the adjusting screw is hinged on the bottom board, said air-supply pipe being arranged between the supporting wheel and the friction driver.

9. The pneumatic device for cleaning ventilation ducts according to claim 8, wherein screws are also arranged on said bottom board for clamping a fixing bracket.

* * * * *

UNITED STATES PATENT AND TRADEMARK OFFICE

CERTIFICATE OF CORRECTION

PATENT NO. : 7,516,509 B2
APPLICATION NO. : 11/817317
DATED : April 14, 2009
INVENTOR(S) : J. Yu It is certified that error appears in the above-identified patent and that said Letters Patent is hereby corrected as shown below:

| COLUMN | LINE | ERROR |
|---|---|---|
| 6 (Claim 4, line 10) | 66 | after "center line of" insert --the-- |
| 8 (Claim 8, line 6) | 6 | after "supporting wheel" insert --,-- |

Signed and Sealed this

Fifteenth Day of September, 2009

David J. Kappos

David J. Kappos
*Director of the United States Patent and Trademark Office*